United States Patent [19]

Patrichi et al.

[11] 4,412,420

[45] Nov. 1, 1983

[54] EXPLOSIVE ACTUATED PIN PULLER

[75] Inventors: Mihai D. Patrichi, Los Angeles; Delbert L. Evanson, Mission Hills, both of Calif.

[73] Assignee: Networks Electronics Corp., Chatsworth, Calif.

[21] Appl. No.: 165,732

[22] Filed: Jul. 3, 1980

[51] Int. Cl.[3] ..... F01B 29/08

[52] U.S. Cl. ..... 60/635; 60/636

[58] Field of Search ..... 60/635, 636

[56] References Cited

U.S. PATENT DOCUMENTS

| | | | |
|---|---|---|---|
| 2,815,008 | 12/1957 | Hirt | 60/636 |
| 3,120,591 | 2/1964 | Lewis et al. | 60/635 |
| 3,261,261 | 7/1966 | Brown | 60/635 |
| 3,888,085 | 6/1975 | Larsonneur | 60/635 |
| 3,893,298 | 7/1975 | Williams | 60/635 |
| 4,008,780 | 2/1977 | Bendler et al. | 60/635 |
| 4,091,621 | 5/1978 | Patrichi | 60/635 |

*Primary Examiner*—Wendell E. Burns

*Attorney, Agent, or Firm*—Lynn H. Latta

[57] ABSTRACT

A pin puller comprising a piston having a pull shaft extending from a cylinder in which the piston is slidable, is actuated by an explosive charge contained within a cartridge disposed laterally of the cylinder. The charge, when ignited, develops a pressurized gas which is directed into the cylinder through a lateral port therein, and acts against the piston to move it in a direction to exert a pull upon the shaft and a pull-actuated device connected thereto.

7 Claims, 6 Drawing Figures

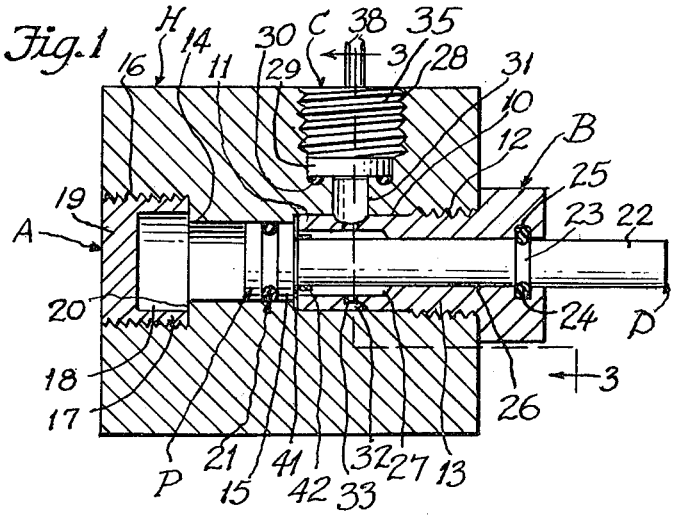
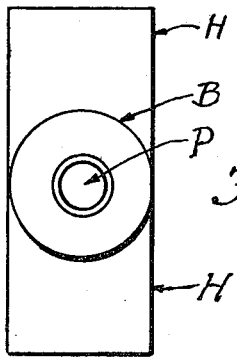
Fig2
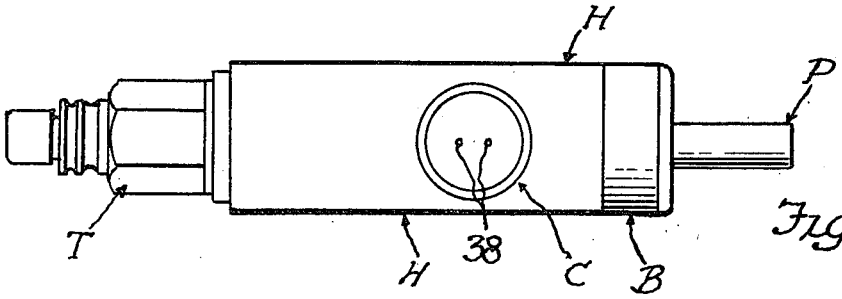
Fig.3
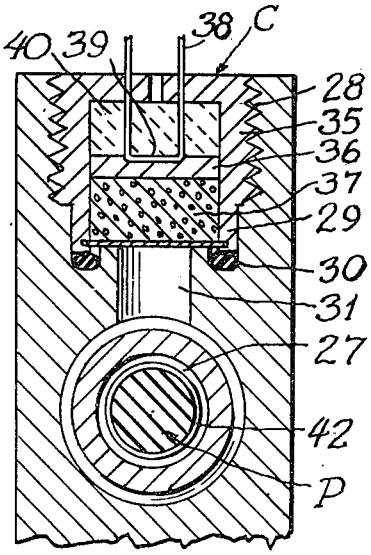
Fig.5
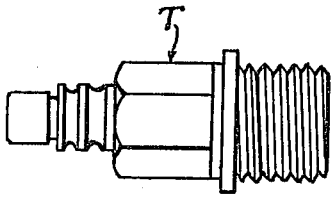
Fig.4
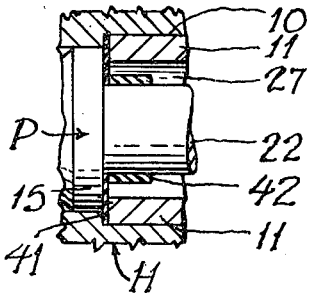
Fig.6

EXPLOSIVE ACTUATED PIN PULLER

BACKGROUND OF THE INVENTION

Actuators of the pulling type, actuated by the explosion of a capsule, are disclosed in prior U.S. Pat. Nos. Patrichi 4,054,032; Leaman 3,024,592; Cordell 3,594,890; Williams 3,893,298. The Patrichi patent discloses an actuator wherein the explosive cartridge is mounted in one end of the cylinder in which the piston is slidable with its pull rod projecting from the other end of the cylinder, the pressurized gas being directed, through a transfer tube, into a chamber extending through the piston and into the piston shaft, from which it is directed outwardly through a lateral port in the shaft into a sealed space behind the piston, so as to move the piston in a direction to exert a pull upon the shaft and a pull-actuated device connected thereto. The Leaman patent discloses a cylinder in which a piston is slidable, the piston having a stem provided with an axial bore and radial ports for transferring the explosive gases to the back side of the piston for retracting the stem. The explosive capsule is mounted in the head of the piston. The reference does not disclose a transfer tube for directing the gas of explosion into the piston. In the present invention, the explosive charge is contained in a capsule mounted in the side of the cylinder, thus simplifying the construction.

RESUME OF THE INVENTION

The invention provides an actuator of single stroke requirement which is especially designed for embodiment in miniature size, powered by detonation of an explosive charge mounted in the side of the block in which the piston cylinder is formed and in which the shaft bearing is installed. A port communicating radially with an annular chamber within the shaft bearing, directs the pressurized gas of the explosion against the piston so as to draw the shaft into the cylinder to effect the pull operation.

The miniature size and weight of the actuator make it especially suitable for single-stroke actuation of a stage operation in the flight of a missile or outer space vehicle, and its simplicity of construction makes it ideally suitable for operation with no substantial likelihood of failure. Also, its detonative operation makes it especially suitable for split-second timing requirement for stage operation of such a vehicle.

The provision of an actuator having such capabilities is the general object of the invention. Other objects will become apparent in the ensuing specifications, in which:

FIG. 1 is a sectional view taken in a plane midway between and parallel to the major sides of the unit;

FIG. 2 is a view of the end of the unit from which the actuator shaft projects;

FIG. 3 is a sectional view of the upper two thirds of the same end of the unit;

FIG. 4 is a side view of the pressure transducer which can be inserted into the unit in place of the plug which normally closes the piston cylinder;

FIG. 5 is a plan view of the unit with the transducer installed, which will register the pressure exerted;

FIG. 6 is a detail of the piston locking means.

DETAILED DESCRIPTION

Referring now to the drawing in detail, I have shown therein, as an example of one form in which the invention may be embodied, a pyrotechnic pin puller comprising, in general, a housing block H defining a piston bore, a slide bushing B, a plug A closing a pressure relief chamber R therein, a piston P having a stem slidable in an axial bore in bushing B, the piston head being slidable in the piston bore, and an ignition cartridge C mounted in block H on an axis transverse to the bore axis and communicating with bushing B through ports in the block and in the bushing.

Housing H has on its major axis a longitudinal bore including a cylindrical intermediate portion 10 in which the reduced inner end portion of bushing B is snugly fitted; an internally threaded portion 12 which receives the threaded shank 13 of the plug; a reduced diameter cylinder 14 in which the head of piston P is fitted for its operative stroke, and a larger end portion 16, internally threaded to receive the threaded barrel 17 of plug A. The plug defines a cylindrical chamber 18, closed by end wall 19, and somewhat larger in diameter than cylinder 14, so as to provide a locking shoulder 20 to receive an expandible O-ring 21 of piston 15 to lock the piston against retraction following its projection. Piston shaft 22 has a circumferential groove 23 in which is engaged an O-ring 24, contained within an annular groove 25 in the head of bushing B prior to operative projection of piston 15 and its shaft 22. The latter is slidably mounted in a bore 26 in the bushing, which has an annular passage 27 surrounding shaft 22 in its intermediate portion 11, the latter being fitted in housing bore 10. Passage 27 receives the gases of explosion of cartridge C.

Cartridge C is threaded into an internally threaded bore 28 in one side of housing block H, on an axis intersecting the common longitudinal axis of bores 10, 14 and 26, and of chamber 18, and has a tip 29 which is compressively sealed against an O-ring 30 seated in an annular groove in housing H. Said groove surrounds a port 31 in housing H, which directs the gases of explosion from cartridge C into an annular passage 32 in the inner end portion 11 of bushing B, from which the gases are directed through radial ports 33 into the annular cylinder passage 27 and thence against the piston head 15.

Cartridge C comprises a shell 35, containing an ignition charge 36 in contact with an explosive charge 37 which communicates with port 31 so as to deliver the pressurized gases of explosion through ports 33 into annular passage 27 for action against piston 15. Ignition of charge 36 is effected by an electric current applied across connector tails 38 to a fusible link 39 embedded in charge 36. Tails 38 are sealed in a glass plug 40 closing the outer end of cartridge C.

Referring now to FIG. 6, a washer 41 of tough material such as Mylar, is installed on shaft 22 with a press fit to lock piston P in place prior to firing, and is backed up by a bushing 42 which is also installed on the shaft with a press fit to hold the washer 41 in place.

OPERATION

With the pin puller in the inactive state shown in the drawing, it is ready to be activated by an electric current transmitted through connector tails 38. The application of such current will heat the fusible link 39 to a temperature sufficiently high to detonate explosive ignition charge 36, which in turn will ignite the main charge 37, creating a volume of gas sufficient to move piston P from its position shown, to a position pushed into cylinder 14 to a point where piston head 15 has entered plug chamber 18 sufficiently for O-ring 21 to expand in the chamber so as to lock the piston against retrograde movement.

We claim:

1. An explosive actuated pin puller comprising:

a piston including a head and a stem extending from the rear side thereof;

a housing defining a cylinder in which said head is slidable in an actuator stroke;

a slide bushing mounted in said housing, said bushing having a bore in which said stem is slidable in an actuating stroke, said bushing defining a passage extending along said stem to the back side of said head;

said bushing having in its outer end an internal O-ring groove, said stem having an external O-ring groove aligned with said bushing groove prior to projection;

a compressibly yieldable O-ring seated in said grooves and restraining said piston from projection prior to detonation of said cartridge; and an ignition cartridge mounted in a side of said housing and communicating with said passage through a port extending radially of the axis of said piston;

said cartridge including detonative means for providing a quantity of compressed gas transmittable through said radially extending port and said passage, and active against the rear side of said piston head to project the piston in an actuative stroke.

2. A pin puller as defined in claim 1, said piston having a circumferential groove;

and a yieldable ring engaged in said groove and operative to restrain piston projection until detonation.

3. A pin puller as defined in claim 1, wherein said housing has a chamber of larger diameter than said cylinder, communicating therewith to provide a locking shoulder at the end of said cylinder;

and wherein said piston head is provided with a circumferential groove;

and an O-ring of compressible material seated in said groove and expandible into engagement with said shoulder at the end of the piston's stroke, whereby to lock the piston against retraction from its projected position, and to relieve the back pressure.

4. A pin puller as defined in claim 1, wherein said passage-defining means comprises a bushing fixed in said housing and having an axial bore in which said stem is slidably received.

5. An explosive actuated pin puller comprising:

a piston including a head and a stem extending from the rear side thereof;

a housing defining a cylinder in which said head is slidable in an actuator stroke;

said housing having a chamber of larger diameter than said cylinder, coaxial therewith and communicating therewith to provide a locking shoulder at the end of said cylinder;

a plug fixed in and closing the outer end of said chamber;

a bushing fixed in said housing in the end thereof remote from said plug and having a bore in which said piston stem is slidably mounted, coaxial with said cylinder and chamber;

said bushing having at its inner end a passage extending along said stem to the back side of said head;

and an ignition cartridge mounted in a side of said housing and communicating with said passage through aligned and communicating ports in said housing and the inner end of said bushing, on an axis extending radially of the axis of said cylinder, chamber and bushing bore;

said cartridge including detonative means for providing a quantity of compressed gas transmittable through said radially extending ports and said passage, and active against the rear side of said piston head to project the piston in an actuative stroke;

said piston having radially expandible means engageable against said locking shoulder at the end of its stroke, operable to lock the piston against retraction and to relieve the back pressure.

6. A pin puller as defined in claim 5, wherein said piston locking means comprises an annular groove in the circumference of said piston; and a compressible ring seated in said groove and expandible upon entry into said chamber.

7. A pin puller as defined in claim 5, wherein said bushing has in its outer end an internal O-ring groove, and wherein said stem has an external O-ring groove aligned with said bushing groove prior to projection;

and a compressibly yieldable O-ring seated in said grooves and restraining said piston from projection prior to detonation of said cartridge;

a washer of stiff material such as Mylar press fitted over said piston stem to lock the piston prior to firing;

and a bushing press fitted on said piston stem to hold said washer in place prior to firing.

* * * * *